US011560869B2

(12) United States Patent
Bengtsson et al.

(10) Patent No.: US 11,560,869 B2
(45) Date of Patent: Jan. 24, 2023

(54) ELECTRONIC CIRCUIT AND CAPACITOR DISCHARGE SYSTEM COMPRISING ELECTRONIC CIRCUIT

(71) Applicant: SEM AB, Åmål (SE)

(72) Inventors: Jörgen Bengtsson, Svanskog (SE); Bert Gustafsson, Åmål (SE); Johan Eklund, Åmål (SE); Tomas Karlsson, Åmål (SE); Lars Svensson, Åmål (SE)

(73) Assignee: SEM AB, Åmål (SE)

( * ) Notice: Subject to any disclaimer, the term of this patent is extended or adjusted under 35 U.S.C. 154(b) by 0 days.

(21) Appl. No.: 17/559,055

(22) Filed: Dec. 22, 2021

(65) Prior Publication Data

US 2022/0252034 A1 Aug. 11, 2022

(30) Foreign Application Priority Data

Dec. 22, 2020 (SE) ..... 2051548-2

(51) Int. Cl.
*F02P 3/04* (2006.01)

(52) U.S. Cl.
CPC ..... *F02P 3/0407* (2013.01)

(58) Field of Classification Search
USPC ..... 123/596, 605, 618
See application file for complete search history.

(56) References Cited

U.S. PATENT DOCUMENTS 6,662,792 B2 12/2003 Dutt et al.

*Primary Examiner* — Hai H Huynh

(74) *Attorney, Agent, or Firm* — Joseph T. Leone; DeWitt LLP

(57) ABSTRACT

An electronic circuit (101) for controlling a spark of a spark plug (SP1) in a capacitor discharge ignition system (100) for a combustion engine. The electronic circuit (101) comprises an ignition coil (110) dimensioned and configured to provide current to the spark plug (SP1), an ignition capacitor (C1) dimensioned and configured to supply energy to the primary winding (L1), an voltage source (130) dimensioned and configured to supply energy to at least one of the ignition capacitor (C1) and the primary winding (L1), a first switch (SW1) connected to the first primary terminal (TL1) and the first source terminal (TS1), a second switch (SW2) connected to the second capacitor terminal (TC2) and the second source terminal (TS2), and a third switch (SW3) connected to the second capacitor terminal (TC2) and the first source terminal (TS1). A capacitor discharge ignition system (100) including the electronic circuit (101) and a combustion engine including the capacitor discharge ignition system (100).

19 Claims, 9 Drawing Sheets

ELECTRONIC CIRCUIT AND CAPACITOR DISCHARGE SYSTEM COMPRISING ELECTRONIC CIRCUIT

CROSS-REFERENCE TO RELATED APPLICATIONS

Priority is hereby claimed under 35 U.S. Code § 119 to Swedish Patent Application Serial No. 2051548-2, filed Dec. 22, 2020, which is incorporated herein by reference.

TECHNICAL FIELD

Embodiments herein relate to ignition systems in spark-ignited internal combustion engines (SI-ICE), such as capacitor discharge ignition (CDI) system or the like. Examples of such combustion engines are natural- and bio-gas powered engines, hydrogen powered engines, gasoline powered engines, engines powered by alcohol such as methanol or ethanol, engines powered by ammonia and other fuels suitable for SI-ICE applications. In particular, an electronic circuit for said systems and a capacitor discharge ignition system comprising the electronic circuit as well as a combustion engine comprising such capacitor discharge ignition system are disclosed.

BACKGROUND

Automotive ignition systems produce high voltage electrical discharges at the terminals of one or more spark plugs to ignite a compressed air fuel mixture. The electrical discharge is required to be released when the piston is at a particular physical position inside the cylinder. Further, to optimize engine performance, improve fuel economy, minimize spark plug electrode wear, and polluting emissions, the time of occurrence and duration of the spark should be controllable in accordance with a predefined discharge profile.

A typical CDI system, illustrated in FIG. 1, has a capacitor C1 as energy storage. Energy stored is $E=\frac{1}{2}\times C1\times U^2$. A voltage level U is supplied to the capacitor C1 by a voltage source V1 when a switch SW1 is open and switch SW4 is closed. When the capacitor C1 has been charged to a pre-defined voltage level U, the further switch SW4 is opened and when the switch SW1 closes a spark is released over the spark plug electrodes as follows. A transformer T is connected to the capacitor C1 which is arranged to supply a very high voltage to a spark plug SP1. A high voltage over the spark plug SP1 is required to create a plasma, i.e., a spark. To achieve the high voltage some hundred volts is applied over the transformer's primary coil L1, which transforms these some hundred volts up to some 50 kV, i.e., the high voltage required to create a flash-over, a spark.

The transformer primary coil L1 and the capacitor C1 constitute a so-called resonance circuit with frequency $1/\sqrt{(L1\times C1)}$. The resonance would continue endlessly if it weren't for energy losses that exist in the physical components of the CDI system. Energy losses give rise to heat, and accordingly the energy output to the spark is reduced.

FIG. 2 illustrates the voltage over the capacitor C1 as a function of time, see solid line, and the current through the primary coil L1, see dotted line. Moreover, a graph, see dashed line, illustrates voltage over spark gap, or spark plug electrodes, as a function of time. The graphs are in different scales and units to improve legibility. At time t0, the switch SW1, as shown in FIG. 1, is opened and the further switch SW4, also shown in FIG. 1, is closed. At time t1, the switch SW1 is closed and the further switch SW4 is opened to form the spark. The current through the primary coil begins and increases while the voltage over the capacitor decreases. The increasing current through the primary coil is transformed to an increasing voltage over the secondary coil. The (voltage) increase continues until the voltage across the spark plug electrodes is so high that an electric break-down is created, generating a plasma between the spark plug electrodes, i.e., a spark has been initiated. The polarity of the spark alternates thereafter due to the resonant circuit formed by the capacitor C1 and the transformer T, known to be a resonant circuit of this kind. Eventually, the spark is extinguished (not shown). Additionally, FIG. 3 illustrates current through the spark gap, see solid line, and current through primary coil, see dotted line. Time t1 is the same as in FIG. 2.

Various solutions for varying spark duration in CDI systems exist. For example, U.S. Pat. No. 6,662,792, issued Dec. 16, 2003, to Dutt et al. discloses a capacitor discharge ignition (CDI) system that is capable of generating intense continuous electrical discharge at a spark gap for a desired duration and may include a second controllable power switching circuit with its input terminal connected to an output terminal of a high voltage DC source device. An output terminal of the second controllable power switching circuit is connected to an input terminal of a first power switching circuit. The second controllable power switching circuit may also have a control terminal connected to an output of a controller. The first controllable power switching circuit may be used for discharging a discharge capacitor, and the second controllable power switching circuit may cause charging of the discharge capacitor. As such, an ignition current through an ignition coil of the system is enabled for any desired number of cycles during both the charge and discharge cycles of the discharge capacitor. A train of ignition current signals makes the spark extendable to any desired length of time. However, a disadvantage with such a solution is a limited flexibility to generate a spark with desired properties, and a high production cost. For some applications, specifically for applications requiring flexible spark characteristics and cost-efficient solutions, such as SI-ICE fuelled by alternative and renewable fuels, new, more cost-efficient and flexible solutions are required.

SUMMARY

An object may be to at least mitigate the abovementioned disadvantage(s) and/or problem(s).

According to an aspect, the object is achieved by an electronic circuit for controlling a spark of a spark plug in a capacitor discharge ignition system for a combustion engine. The electronic circuit comprises an ignition coil arranged to provide current to the spark plug. The ignition coil comprises a primary winding, having a first primary terminal and a second primary terminal, and a secondary winding across which the spark plug is connectable. The electronic circuit comprises an ignition capacitor arranged to be capable of supplying energy to the primary winding. The ignition capacitor has a first capacitor terminal and a second capacitor terminal. The first capacitor terminal is connected to the second primary terminal. The electronic circuit comprises a voltage source arranged to be capable of supplying energy to at least one of the ignition capacitor and the primary winding. The voltage source has a first source terminal and a second source terminal.

Moreover, the electronic circuit comprises a first switch, a second switch and a third switch. The first switch is connected to the first primary terminal and the first source terminal. The second switch is connected to the second capacitor terminal and the second source terminal. The third switch is connected to the second capacitor terminal and the first source terminal.

According to another aspect, the object is achieved by a capacitor discharge ignition system comprising the electronic circuit according to any one of the embodiments disclosed herein.

According to a further aspect, the object is achieved by a combustion engine comprising a capacitor discharge ignition system as disclosed herein.

Thanks to the first, second and third switches, the electronic circuit enables control of characteristics of the spark in an efficient and independent manner. By means of adjusting the voltage source, an ignition voltage available for charging the ignition capacitor, control of certain characteristics of the spark may be enabled. For example, each of the following characteristics, comprising e.g., spark duration, ignition voltage and spark current, may be controlled independently from the other characteristics according to at least some embodiments.

An advantage is hence that at least some embodiments herein enable flexible control of the spark, e.g., in a cost-efficient manner.

In some embodiments, the electronic circuit comprises a fourth switch connected to the second primary terminal and the second source terminal. In this manner, requirements on the voltage source, e.g., in terms of output voltage and/or output current, may be relaxed. Accordingly, with relax requirements, cost of the voltage source may be reduced.

In some embodiments, the electronic circuit comprises a fifth switch connected to the first capacitor terminal and the first source terminal. In this manner, any residual charge held by the ignition capacitor may be discharged after the spark has extinguished, thereby resetting a state of charge of the ignition capacitor. An advantage may be that the ignition capacitor's state of charge is known, or defined, such that a subsequent spark may be controlled as desired, i.e., starting from a known state of charge of the ignition capacitor. This may be particularly useful for controlling the spark duration.

In some embodiments, the electronic circuit comprises a storage capacitor connected to the first source terminal and the second switch, and a sixth switch connected to the second source terminal and the storage capacitor. The second switch is connected to the second source terminal by being indirectly connected to the second source terminal via the sixth switch, which is connected to the second switch. In this manner, a sum of voltages over the storage capacitor and the voltage source may be applied when the first switch is closed, the second switch closed, the sixth switch closed, the third switch open, the fourth switch open and the fifth switch open. An advantage is hence that maximum voltage requirements on the voltage source may be relaxed, e.g., as compared to at least some of the embodiments herein, i.e., a cost-efficient solution.

In some embodiments, the electronic circuit comprises a control unit, which may be configured to perform various methods to control one or more of spark duration, ignition voltage and spark current.

An advantage is hence that the electronic circuit may achieve, e.g., upon use within a combustion engine, control of the spark characteristics as disclosed herein.

BRIEF DESCRIPTION OF THE DRAWINGS

The various aspects of embodiments disclosed herein, including particular features and advantages thereof, will be readily understood from the following detailed description and the accompanying drawings, which are briefly described in the following.

DETAILED DESCRIPTION

Figure 1:
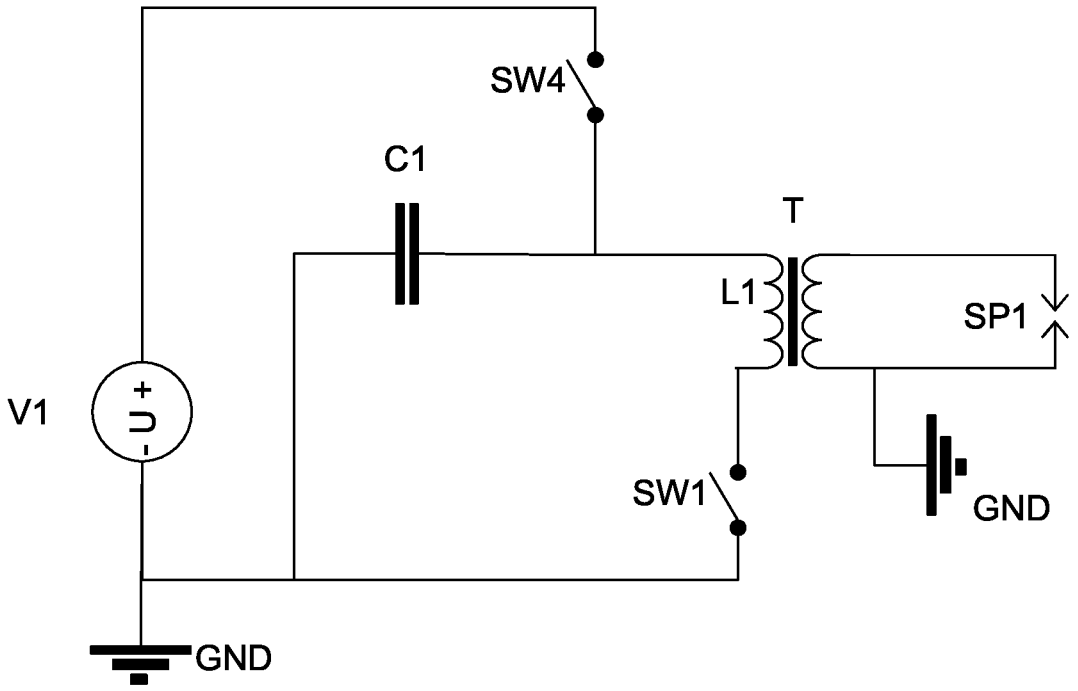
Fig. 1 (Prior Art)
FIG. 1 is a schematic overview of an exemplifying electronic circuit for a CDI system according to prior art.
Figure 2:
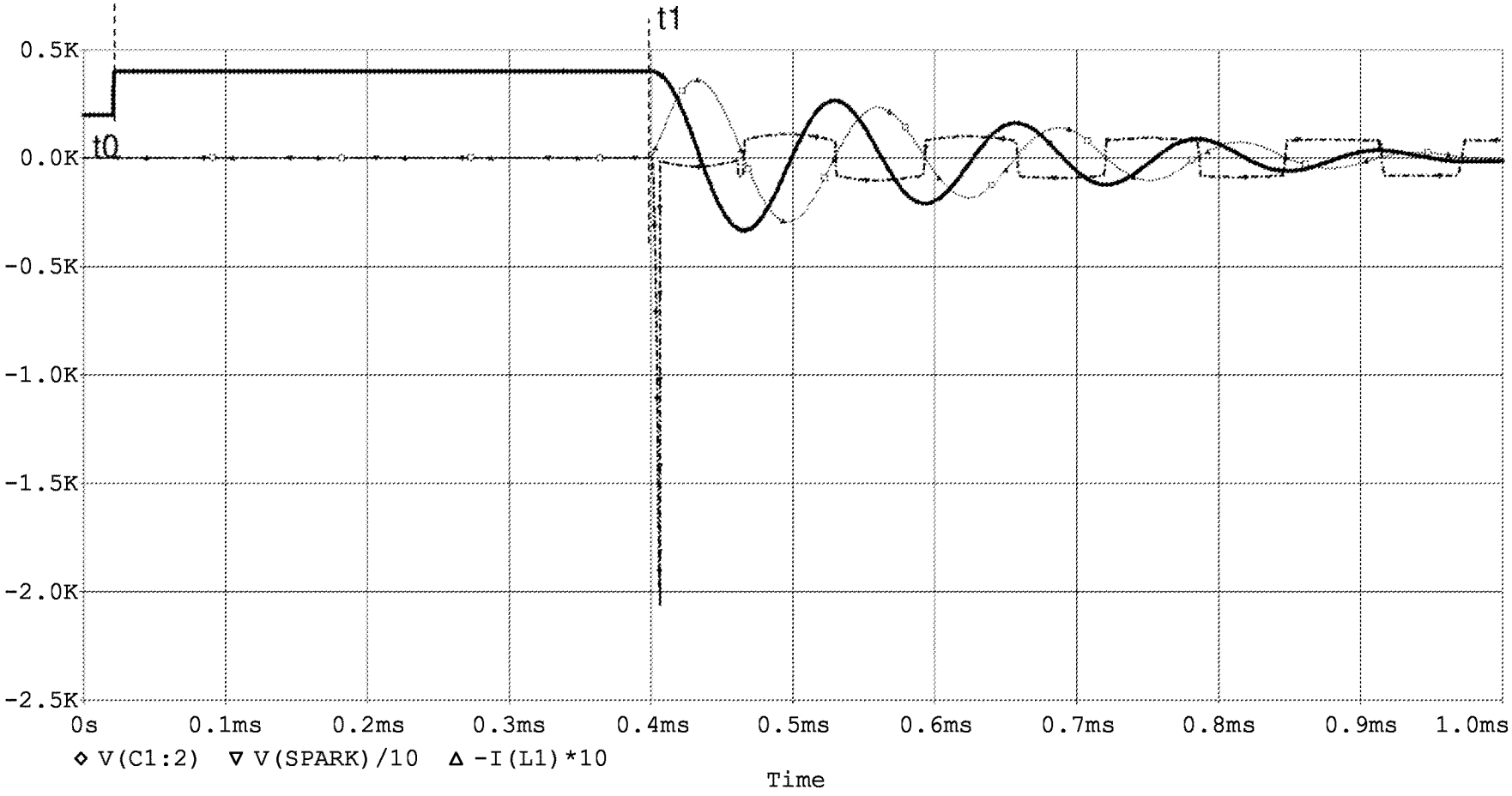
Fig. 2 (Prior Art)
FIG. 2 and FIG. 3 are graphs illustrating exemplifying currents and voltages during operation of the known electronic circuit of FIG. 1.
Figure 3:
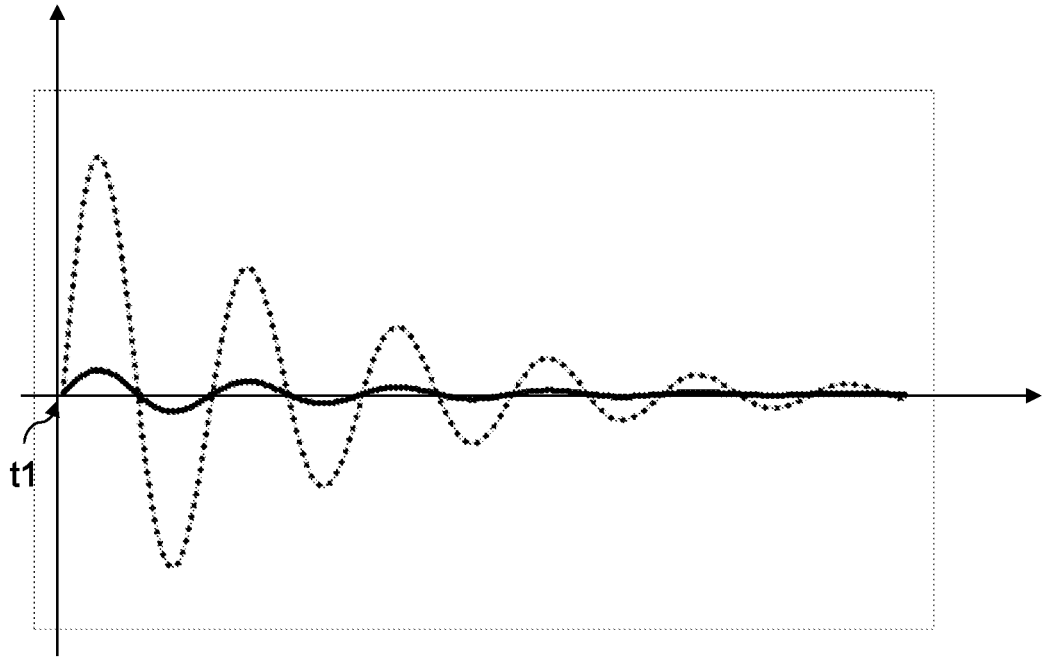
Fig. 3 (Prior Art)

Throughout the following description, similar reference numerals have been used to denote similar features, such as nodes, actions, modules, circuits, parts, items, elements, units or the like, when applicable.

Figure 4:
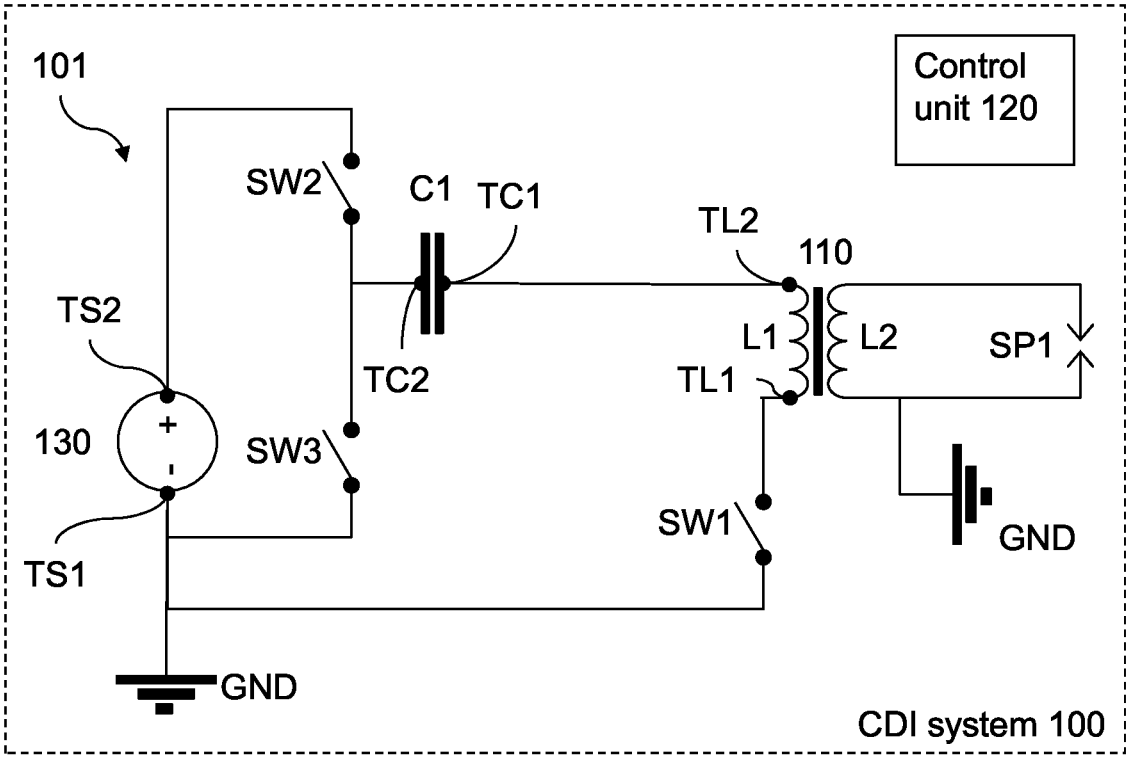
FIG. 4 is a schematic circuit diagram of an exemplifying electronic circuit according to embodiments herein.

FIG. 4 depicts an exemplifying electronic circuit 101 for controlling a spark of a spark plug SP1 in a capacitor discharge ignition system 100 for a combustion engine.

The electronic circuit 101 comprises an ignition coil 110 arranged to provide current to the spark plug SP1. The ignition coil 110 comprises a primary winding L1, having a first primary terminal TL1 and a second primary terminal TL2, and a secondary winding L2 across which the spark plug SP1 is connectable. In case of multiple cylinders, there is a respective ignition coil for each cylinder.

The electronic circuit 101 further comprises an ignition capacitor C1 arranged to be capable of supplying energy to the primary winding L1. The ignition capacitor C1 has a first capacitor terminal TC1 and a second capacitor terminal TC2. The first capacitor terminal TC1 is connected to the second primary terminal TL2.

Moreover, the electronic circuit 101 comprises a voltage source 130 arranged to be capable of supplying energy to at least one of the ignition capacitor C1 and the primary winding L1. The voltage source 130 has a first source terminal TS1 and a second source terminal TS2. The voltage source 130 may e.g., be powered from e.g., a 12 V or 24 V battery provided in connection with the combustion engine. The voltage source 130 may be an adjustable voltage source, such as a boost converter, step-up converter, buck-boost converter or the like.

The electronic circuit 101 additionally comprises a first switch SW1 connected to the first primary terminal TL1 and the first source terminal TS1. In case of multiple cylinders, there is a respective switch for each cylinder. Such respective switch is connected in the same, similar or corresponding manner as the first switch SW1 with respect to its corresponding cylinder.

Furthermore, the electronic circuit 101 comprises a second switch SW2 connected to the second capacitor terminal TC2 and the second source terminal TS2.

FIG. 4 further illustrates that the electronic circuit 101 comprises a third switch SW3 connected to the second capacitor terminal TC2 and the first source terminal TS1.

The second switch SW2 and the third switch SW3 and the way they are connected in the electronic circuit 101 enables switching of to where energy is fed from the voltage source 130.

Notably, throughout the present disclosure, the switches are illustrated as ideal switches. In practical implementen-tions, protective diodes, further components, and/or the like may be provided.

As used herein, the term "connected to" may mean directly or indirectly connected to, i.e., via one or more further components.

As used herein, the term "switch" may or may not include additional components, such as diodes, protective diodes or the like.

In some examples, the spark plug SP1 may be considered to be in, or comprised in, the capacitor discharge ignition system. The spark plug is typically in the CDI system since the ignition of the spark of the spark plug is mounted at, or on/in, a cylinder whose ignition is controlled.

The electronic circuit 101 may comprise a control unit 120, such as a microprocessor, microcontroller, a processor circuit, a central processing unit (CPU) or the like.

The control unit 120 may be arranged to open or close one or more of the switches of the electronic circuit 101 according to any one of the embodiments herein. This may be done by that the control unit 120 is electrically connected (not shown) to a respective control port of each switch, such as a base of a transistor switch or the like. The controlling of the switches will be described in more detail below.

Moreover, the control unit 120 may be configured to measure current, such as the secondary current An advantage according to the embodiments herein, it that small ignition coils may be designed, which is a desirable property due to the lack of space in modern SI-ICE. Small sized coils may be designed using a CDI approach, because the energy is stored in the ignition capacitor C1, as opposed to inductive type ignition coils where the energy is stored in a magnetic core in the form of a magnetic field which leads to large ignition coils in order to meet the requirements. Moreover, less energy to create the initial spark (flash over) may be required, since more energy may be added as the spark runs (or glows), i.e., before extinction. Therefore, small sized coils may be used and still meet the requirements on spark properties that come with modern SI-ICE applications.

With at least some embodiments, spark characteristics may be changed individually from one spark to another spark for improved ignitability and significantly reduced spark plug wear. Spark plug electrode wear is a well-known and cost driving problem in SI-ICE applications, due to erosion of the electrodes through evaporation, ejection of molten electrode metal and sputtering due to the impact of high energy particles on the electrode surface. Reduced spark plug electrode wear is achieved by adapting the spark to the engine operating condition and the fuel property such that excessive spark energy and/or power is avoided, or at least reduced.

Also, the solution is well suited for ion-current based combustion diagnostics due to low coil inductance and built-in active coil ringing suppression. When the spark is extinguished, there is still some residual energy in the resonant ignition circuit that will "ring" back and forth describing a decaying sinusoidal signal. Such a ringing will interfere with ion current measurements and make such a measurement un-useful until the ringing has vanished. Clearly, by reducing the inductance in the resonant circuit, the residual (magnetic) energy is reduced and hence, so also the ringing. The active coil ringing suppression offered by the fifth switch SW5 in FIG. 8 further decreases the ringing, improving the ion current capability, or ion sense capability.

The embodiments herein may be particularly suited for hydrogen gas fuelled engines, which typically are more sensitive to so called pre ignition in which case the air-fuel mixture is ignited unintentionally before it should. This may not only reduce the efficiency of the engine, but also be harmful for, or even destroy, the engine. The cause for such pre-ignition may be "spark at make" which may arise at start of dwell in inductive ignition systems, or due to hot spots in the combustion chamber that may be the result of excessive spark energy that may heat the spark plug electrodes. Hydrogen fuelled SI-ICE may especially benefit from a controlled and flexible spark ignition due to the inherent physical properties of hydrogen, and such a controlled and flexible ignition may be enabled with at least some of the embodiments herein.

Figure 5:
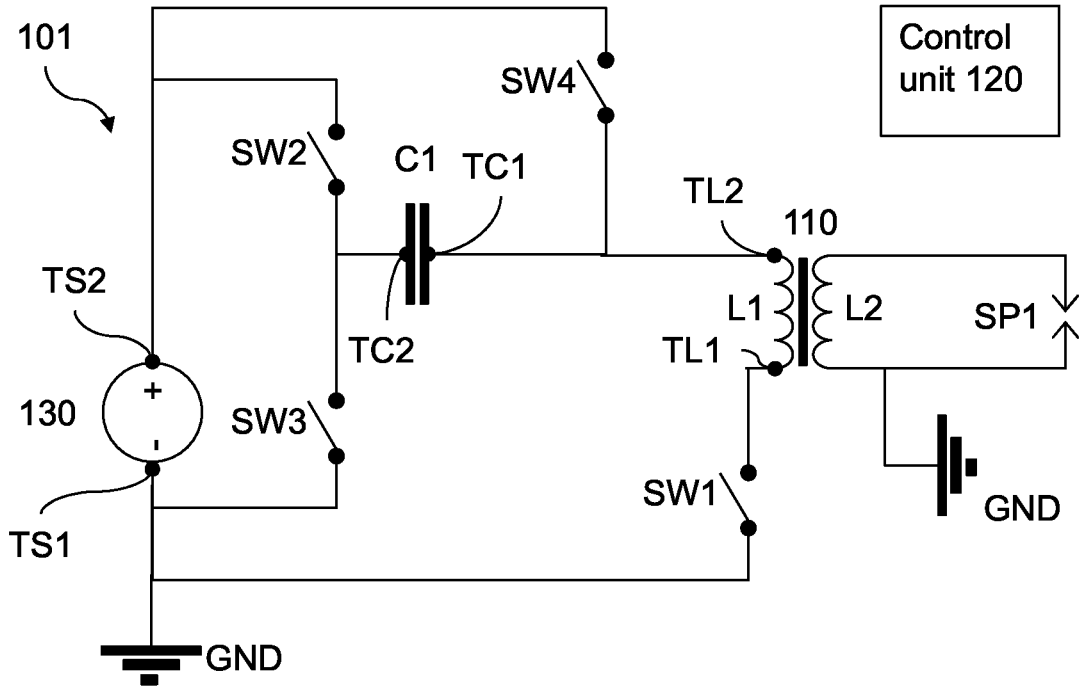
FIG. 5 is a schematic circuit diagram of another exemplifying electronic circuit according to embodiments herein.

Turning to FIG. 5, a fourth switch SW4 has been added to the electronic circuit of FIG. 4. Hence, the electronic circuit 101 may comprise the fourth switch SW4, which may be connected to the second primary terminal TL2 and the second source terminal TS2.

With the fourth switch SW4 closed, the first switch SW1 opened and the second switch SW2 opened and the third switch SW3 closed, the ignition capacitor C1 may be charged without applying any voltage to the primary coil L1. Next, for ignition of the spark, the fourth switch SW4 is opened, the first switch SW1 is closed and the second switch SW2 is closed and the third switch SW3 is opened. Thereby, applying voltages over the ignition capacitor C1 and the voltage source in series over the primary coil L1.

Therefore, voltage requirements on the voltage source 130 may be relaxed thanks to the fourth switch SW4. For example, the 130 may only be required to be able to supply a voltage that is half of the voltage that is needed to be supplied by the voltage source 130 in the example of FIG. 4. The ignition capacitor C1 is typically capable of holding a voltage approximately equal to a maximum voltage available from the voltage source 130 of FIG. 4.

In the following, operation of the electronic circuit 101 of FIG. 5 is illustrated with reference to FIG. 6.

Figure 6:
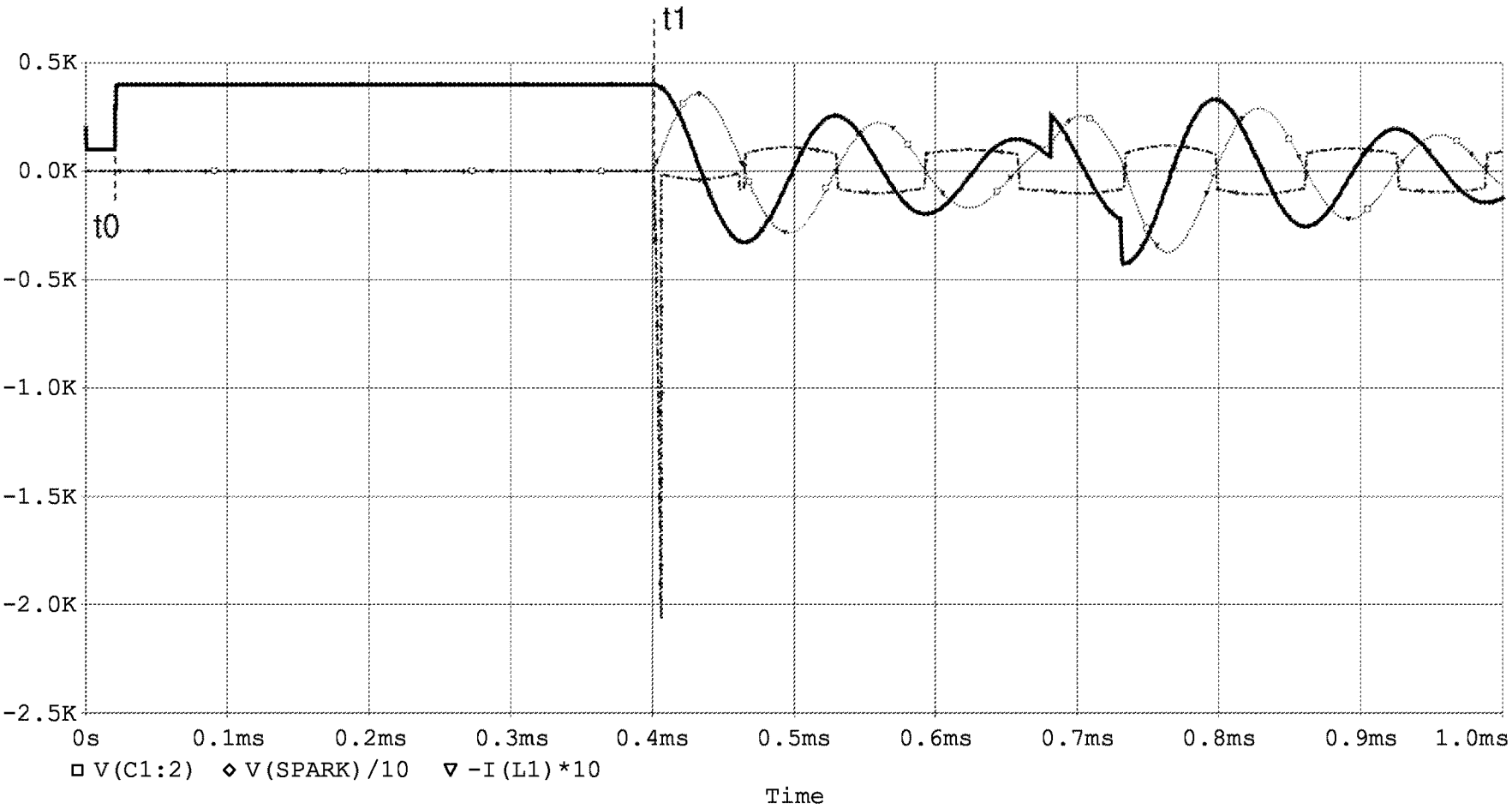
FIGS. 6 and 7 are graphs illustrating exemplifying currents and voltages during operation of the exemplifying electronic circuit of FIG. 5.

FIG. 6 shows voltage over the capacitor C1 as a function of time, see solid line, and current through the primary coil L1, see dotted line. Moreover, a graph, see dashed line, illustrates voltage over the spark gap, or the spark plug SP1, as a function of time. The graphs are in different scales and units to improve legibility. At time t0, the first switch SW1 is open and the fourth switch SW4 is closed. The third switch SW3 is closed and the second switch SW2 is open. In this manner, the capacitor C1 is charged. At time t1, the first switch SW1 and the third switch SW3 are closed and the second switch SW2 and the fourth switch SW4 are opened to form the spark. The current through the primary coil begins and increases while the voltage over the capacitor decreases. The increasing current through the primary coil is transformed to an increasing voltage over the secondary coil. The (voltage) increase continues until the voltage across the spark plug electrodes is so high that an electric break-down is created, generating a plasma between the spark plug electrodes, i.e., a spark has been initiated. While the spark burns it alternates with the oscillations of the voltage over the capacitor C1 and the current through the primary coil.

After a few oscillations, the solid line jumps due to energy supplied in synchrony with the oscillations. Thus, extending the spark duration.

Figure 7:
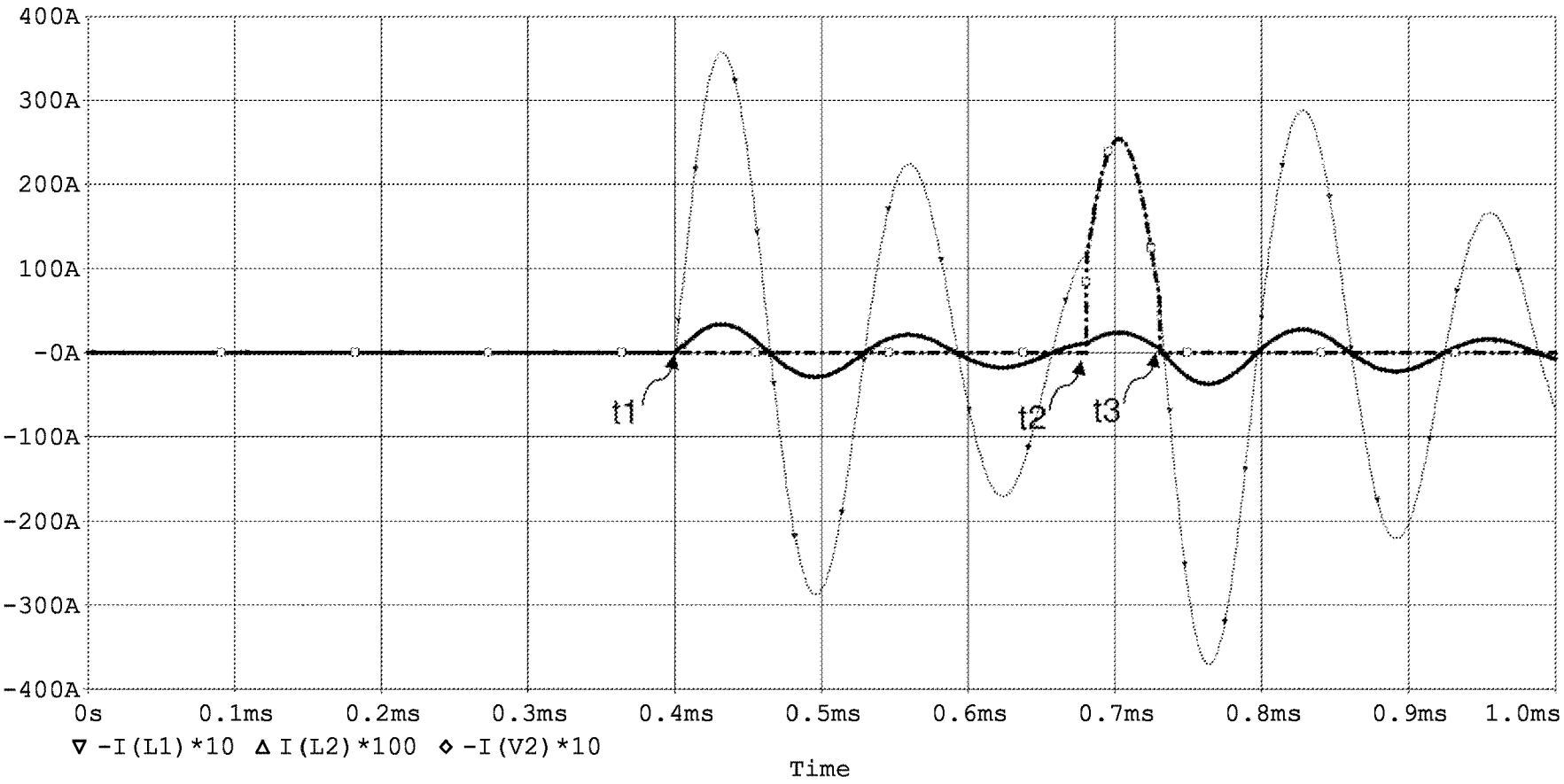

As shown in FIG. 7, the energy—causing the jump or irregularity of the solid line in FIG. 6—is supplied by a current from the voltage source 130 and/or a storage capacitor C2 to be introduced in connection with FIG. 8 below. The control unit 120 may e.g., for this purpose, open the third switch SW3 and close the second switch SW2 at e.g., a point in time t2. At another point in time t3, the control unit 120 may close the third switch SW3 again and open the second switch SW2. The switches SW1, SW2, SW3 and SW4 may remain unchanged until the oscillations decay and the spark is extinguished (not shown). Additionally, FIG. 7 illustrates current through spark gap, see solid line, and current through primary coil, see dotted line. Time t1 is the same as in FIG. 6.

In the table below, it is illustrated how the switches of the electronic circuit of FIG. 5 may be operated in order to control duration, or length, of the spark when generating a spark. This means that when the switches are operated as below with suitable timing a spark with desired characteristics may be generated.

X = Closed switch (current passes through)

| Step | SW1 | SW2 | SW3 | SW4 | Description: |
|---|---|---|---|---|---|
| 0 | | | | | Power up |
| 1 | | | X | X | C1 is charged to desired voltage for spark formation |
| 2 | X | | X | | C1 voltage is causing a current through ignition primary coil L1. |
| 3 | X | X | | | When energy is needed for maintaining spark current C1 is charged from 130. Timing for shift is sycronized with oscillation. |
| 4 | X | | X | | To continue osciallation SW2 is opened and SW3 is closed. For long durations the oscillation is maintained by syncronized repeated shifting of C1 with SW2 and SW3 for energy input or output, syncronized. |
| 5 | | | | | All switches are opened for fast spark turn off |
| 6 | | | | | Return to step 1 for next spark sequence. |

In some examples (not illustrated by an accompanying Table/Figure), the electronic circuit 101 may comprise a fifth switch SW5 connected to the first capacitor terminal TC1 and the first source terminal TS1. In this manner, any residual voltage held by the ignition capacitor C1 may be discharged to the ground GND after the spark has extinguished, thereby resetting a state of charge of the ignition capacitor C1. An advantage may be that the ignition capacitor's state of charge is known, or defined, such that a subsequent spark may be controlled as desired, i.e., starting from a known state of charge of the ignition capacitor. This may be particularly useful for controlling the spark duration.

Figure 8:
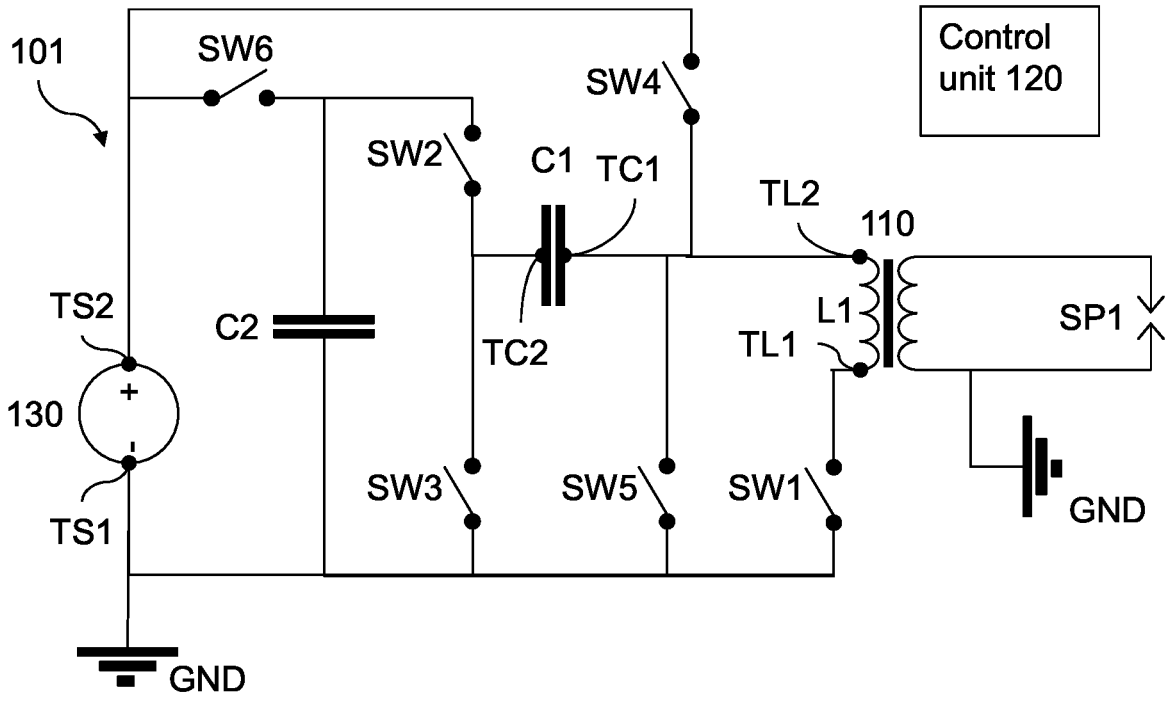
FIG. 8 is a schematic circuit diagram of a further exemplifying electronic circuit according to embodiments herein.

FIG. 8 illustrates a further exemplifying electronic circuit 101. In addition to the electronic circuit 101 of FIG. 5, the further electronic circuit 101 of FIG. 8 further comprises a storage capacitor C2 connected to the first source terminal TS1 and the second switch SW2. It may here be mentioned that the ignition capacitor C1 and the storage capacitor C2 may be referred to as the first capacitor C1 and the second capacitor C2, respectively. This means that the words "ignition" and "storage" are in this context merely used as labels to distinguish the respective capacitors from each other.

Moreover, the electronic circuit 101 of FIG. 8 further comprises a sixth switch SW6 connected to the second source terminal TS2 and the storage capacitor C2. The second switch SW2 is connected to the second source terminal TS2 by being indirectly connected to the second source terminal TS2 via the sixth switch SW6, which is connected to the second switch SW2.

In some examples, there is provided a capacitor discharge ignition system 100 comprising the electronic circuit 101 according to any one of the embodiments herein.

Thanks to the two switches SW2, SW3, energy can be supplied to C1 each period of the resonating ignition circuit, whereby an amplitude (magnitude) of the spark current is maintained, or a decrease thereof is mitigated, hereby maintaining a desired power in the spark to enable robust ignition of the air-fuel mixture. This is done by keeping one of switch SW2/SW3 closed at each moment. When primary current>0 SW3 can be opened and SW2 closed for a time until energy supplied is enough to maintain the spark.

Energy supplied to the CDI system is: $E=\int V1\times I\times dt$. To maintain the spark current amplitude at or above a desired level this energy may preferably be greater than the total energy consumed during the last period of the resonating ignition circuit. Expressed differently:

$$E>Ep+Es+Espark, \text{ where}$$

Ep is losses in primary coil, Ep is dependent of Ip (primary current) and can be tabulated or calculated.

Es is losses in secondary coil, Es is dependent of Is (secondary current) and can be tabulated or calculated, and Espark is energy in the spark. Espark is dependent of Is (spark current) and voltage over gap.

According to FIG. 8, switch SW6, capacitor C2 and switch SW5 has been added to the circuit of FIG. 5. In this manner, the electronic circuit 101 makes it possible to vary the voltage used for maintaining the spark and shut off the spark.

Legend to e.g., FIG. 8.

| Name | Description |
|---|---|
| 130 | Voltage source. |
| SW1 | $1^{st}$ switch (one switch for each coil when used for multi-cylinder engines) |
| SW2 | $2^{nd}$ switch |
| SW3 | $3^{rd}$ switch |
| SW4 | $4^{th}$ switch |
| SW5 | $5^{th}$ switch |
| SW6 | $6^{th}$ switch |
| C1 | Capacitor Discharge-serial Capacitor |
| C2 | Storage capacitor |
| L1 | Primary coil |
| L2 | Secondary coil |
| SP1 | Spark plug |
| 120 | Control unit configured for measuring and controlling the switches |

The table below shows an example of a method for setting the switches to control spark characteristics, such as duration, spark voltage and spark current (or secondary current).

X = Closed switch (current passes through)

| Step | SW1 | SW2 | SW3 | SW4 | SW5 | SW6 | Description: |
|---|---|---|---|---|---|---|---|
| 0 | | | | | | | Power up |
| 1 | | | | | | | C2 is charged to pre set voltage for desired energy. |
| 2 | | | X | X | | | C1 is charged to desired voltage (Voltage in C2 + C1 sets available spark voltage) |
| 3 | X | X | | | | | C1 + C2 voltage is causing a current through ignition primary coil L1. |
| 4 | X | | X | | | | Reference voltage for C2 is shifted to C1. Timing for shift is syncronized with oscillation. |
| 5 | X | | X | | | X | More energy is added to C2 to maintain voltage level (optional). |
| 6 | X | X | | | | | Reference voltage for C2 is shifted to C1. Timing for shift is sycronized with oscillation. |
| 7 | X | | X | | | | For long durations the oscillation is maintained by syncronized repeated shifting of C2 reference with SW2 and SW3. |
| 8 | X | | | | X | | SW 5 is closed to short primary coil and stop coil ringing (optional). |
| 9 | | | | | | | Return to step 1 for next spark sequence. |

The control unit 120 may control the switches based on e.g., measurement of the oscillating secondary current. This means that the control unit 120 may be configured to measure the secondary current. In other examples, the control unit 120 may be configured to control the switches based on e.g., measurement of the oscillating primary current. As used herein, primary current refers to current through the primary coild and secondary current refers to current through the secondary coil.

The voltage across the energy storage capacitor C1 is shown in red above. Some of the energy stored in the capacitor is lost when raising the voltage across the spark plug required to create a spark (flash-over).

Some of the energy stored in the capacitor is lost to maintain the spark and to drive the current through SW1 and the ignition coil (both magnetic and resistive losses) and the (spark) plasma.

This results in that the peak capacitor voltage (charge, energy) is successively reduced, and the voltage-time area of the capacitor (positive, negative, positive, etc) is succesilvey reduced. This means that the current-time area on both the primary side and the secondary side are reduced as well.

Figure 9:
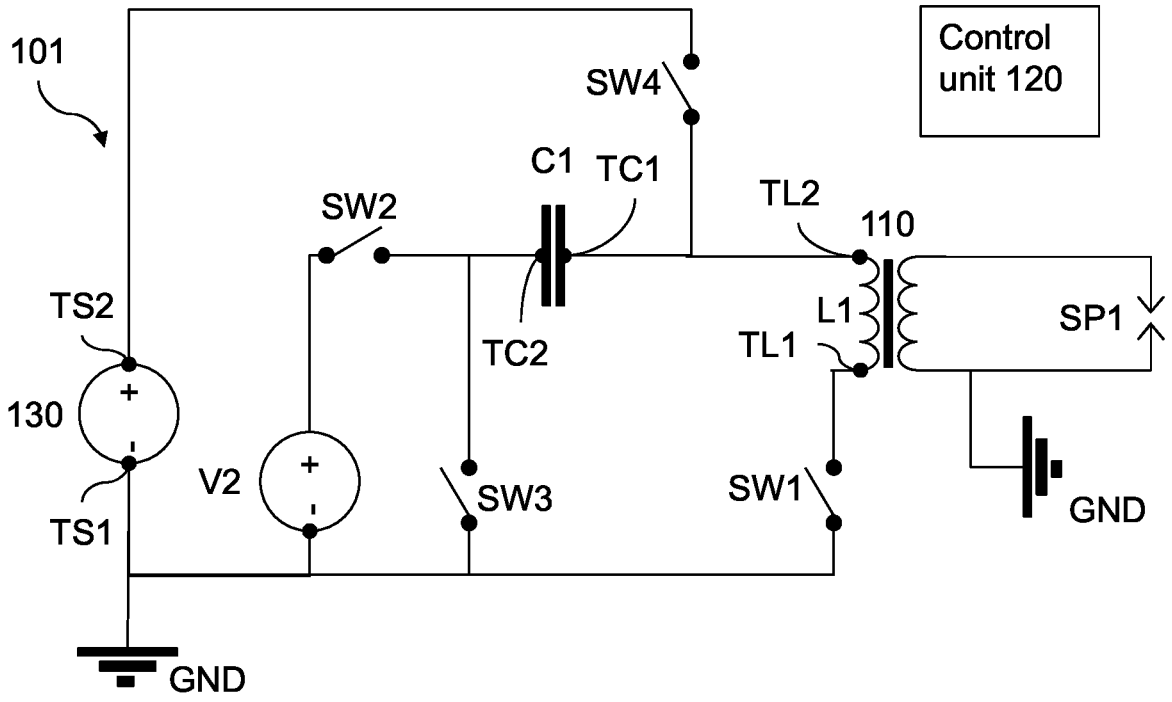
FIG. 9 is a schematic circuit diagram of a still further exemplifying electronic circuit according to embodiments herein.

In case we would like to keep the AC spark current constant for a longer time, or regulate the spark current amplitude, this is possible by adding a time dependent voltage source V2, see FIG. 9, which will add energy to the system. The control unit 120 may be configured to control the voltage output from the time dependent voltage source V2. Hence, it may rather be that the control unit 120 causes the voltage from the voltage source V2 to become time dependent thanks to appropriate control signalling and circuitry for achieve the time dependent voltage. In one example, the electronic circuit 101 of FIG. 9 may be equipped with the fifth switch SW5 connected similarly as shown in FIG. 8. In some examples, the voltage source V2 may not need to be time dependent.

An advantage of the electronic circuit 101 of FIG. 9 may be that the switches may be specified with lower voltage requirements than in the example of FIG. 8.

Turning to FIG. 10*a* through FIG. 10*d*, a principle behind a method e.g. performed by the control unit 120, for controlling at least one spark characteristic, such as ignition voltage, spark current and spark duration, is described.

Figure 10A:
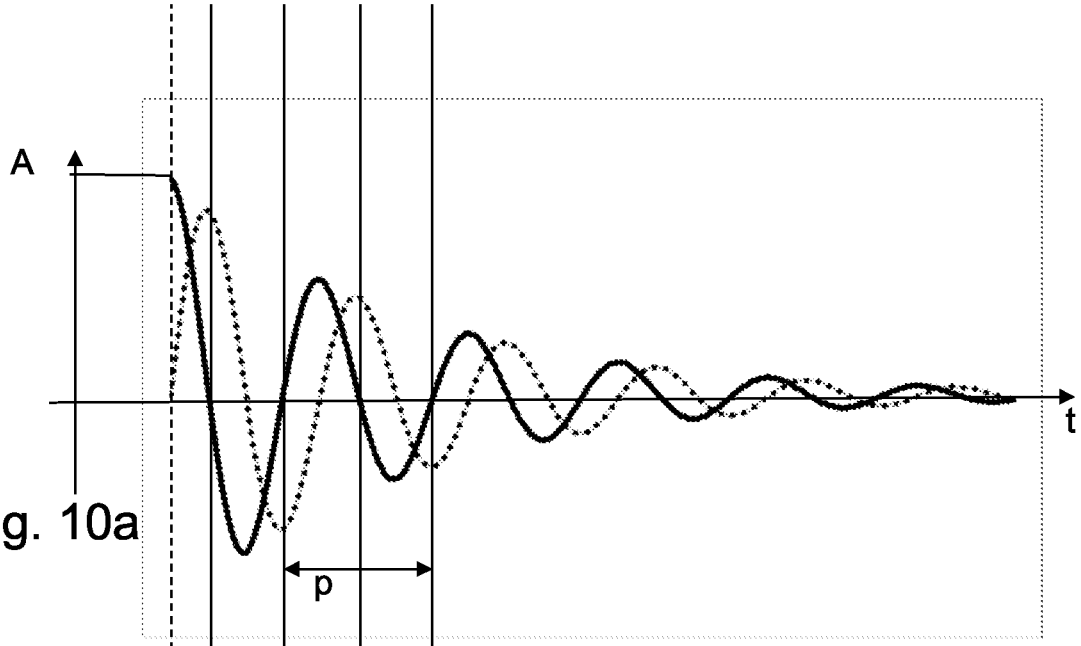
FIG. 10*a* to FIG. 10*d* illustrates some examples of spark control that are enabled by the electronic circuit disclosed herein.

In FIG. 10*a*, the voltage over the capacitor C1 is shown as a solid line and the current through the primary coil PL1 is shown as a dotted line.

Figure 10B:
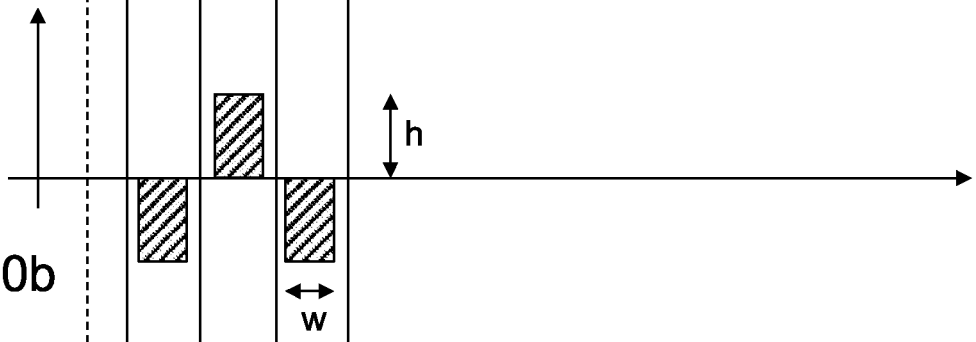

To keep the spark current amplitude constant, a voltage-time area may be added during each period p of the capacitor voltage, or during at least one of the negative and the positive half-period. This can be done by adding a medium high DC voltage in phase with the capacitor voltage during a certain time interval, a higher DC voltage during a shorter time period or a lower DC voltage during a longer time period as indicated in FIG. 10*b*. In this case a voltage of alternating polarity is used. This can be created using a DC voltage source combined with four switches in a H-bridge (full bridge) configuration. The height h and the width d may be varied to add a desired energy level WL, which is proportional to h*w.

Figure 10C:
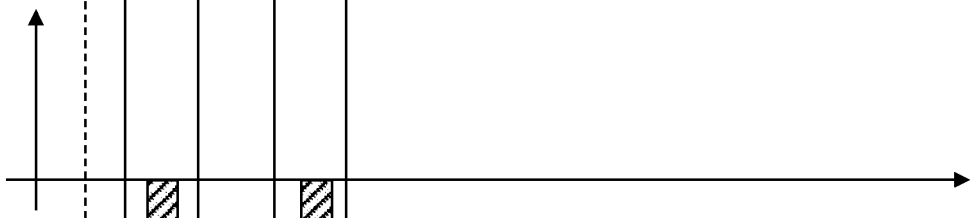

In FIG. 10*c*, a voltage-time area is added only when the capacitor voltage is negative. This is a simpler method which makes it possible to maintain the spark current with only two switches in the form of a half-bridge supplied by a single DC voltage source.

Figure 10D:
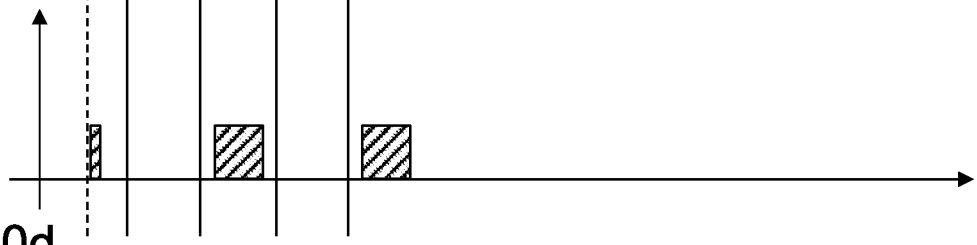

In FIG. 10*d*, the time varying voltage source is also used to form the spark. By doing so, the capacitor C1 does not need to be charged to as high a voltage as in the previous examples e.g., in FIG. 4, FIG. 5 or FIG. 8. As a result, cost of the electronic circuit 101 may be reduced.

CDI systems are normally powered from a 12 V or a 24 V power source e.g., to power the adjustable voltage source 130. The capacitor is typically charged to a voltage of 200-400 V.

The voltage needed to maintain the spark for a long or an infinite time is much smaller than 200-400V. Typically, a voltage in the range of 24-100 V can be used for this purpose.

If a low voltage such as e.g., 24 V can be used, combined with a full bridge to add a voltage of 24 V to the capacitor C1 with different polarity, a very energy efficient system is created, as there is no need for additional voltage conversions between 24 V and a higher voltage, such as the aforementioned 200-400 V. This implies a significant cost reduction.

Also, in case a higher voltage than 24 V is used, but in the interval of 24-100 V a system can be designed at lower cost and lower losses than when using a system with only one energy source at 200-400 V.

If only one voltage source V is used both for charging the capacitor C1 and for the creating the time varying voltage source V2, the voltage source can be reduced from typically 200-400 V to 100-200 V, which also simplifies the design of the CDI system This can be done by connecting the voltage source V2=V to the left side of the capacitor C1 charged to a voltage of V, (see graph 5) which means that the voltage 2*V is connected shortly to the primary side of the ignition coil to create the spark.

As illustrated in FIG. 10*b* to FIG. 10*d*, energy is added during at least parts of a period such that the integral reaches desired set point. Thereby individually controlling each of ignition voltage (if adding energy in "first" period), duration of spark and spark current.

If it is desired to increase spark current, but not extend duration energy in opposite phase may be inserted to dampen oscillation faster. Hence, duration and spark current may be controlled individually.

Figure 11:
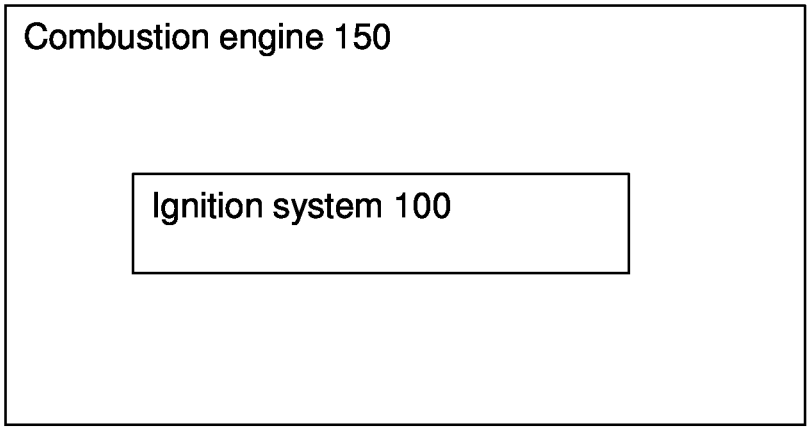
FIG. 11 is a schematic block diagram illustrating an exemplifying combustion engine comprising an embodiment of the ignition system herein.

FIG. 11 shows a combustion engine 150 comprising an exemplifying ignition system 100 according to the embodiments herein. The ignition system 100 may be a CDI system, CDI control system or the like.

As used herein, the terms "first", "second", "third" etc. may have been used merely to distinguish features, apparatuses, elements, units, or the like from one another unless otherwise evident from the context.

As used herein, the term "set of" may refer to one or more of something. For example, a set of devices may refer to one or more devices, a set of parameters may refer to one or more parameters or the like according to the embodiments herein.

As used herein, the expression "in some embodiments" has been used to indicate that the features of the embodiment described may be combined with any other embodiment disclosed herein whenever technically feasible.

Each embodiment, example or feature disclosed herein may, when physically possible, be combined with one or more other embodiments, examples, or features disclosed herein. Furthermore, many different alterations, modifications and the like of the embodiments herein may be become apparent for those skilled in the art. The described embodiments are therefore not intended to limit the scope of the present disclosure.

What is claimed is:

1. An electronic circuit (101) for controlling a spark of a spark plug (SP1) in a capacitor discharge ignition system (100) for a combustion engine, wherein the electronic circuit (101) comprises an ignition coil (110) dimensioned and configured to provide current to the spark plug (SP1), wherein the ignition coil (110) comprises a primary winding (L1), having a first primary terminal (TL1) and a second primary terminal (TL2), and a secondary winding (L2) across which the spark plug (SP1) is connectable, an ignition capacitor (C1) dimensioned and configured to supply energy to the primary winding (L1), wherein the ignition capacitor (C1) has a first capacitor terminal (TC1) and a second capacitor terminal (TC2), wherein the first capacitor terminal (TC1) is connected to the second primary terminal (TL2), a voltage source (130) dimensioned and configured to supply energy to at least one of the ignition capacitor (C1) and the primary winding (L1), wherein the voltage source (130) has a first source terminal (TS1) and a second source terminal (TS2), a first switch (SW1) connected to the first primary terminal (TL1) and the first source terminal (TS1), a second switch (SW2) connected to the second capacitor terminal (TC2) and the second source terminal (TS2), and a third switch (SW3) connected to the second capacitor terminal (TC2) and the first source terminal (TS1).

2. The electronic circuit (101) according to claim 1, wherein the electronic circuit (101) comprises a fourth switch (SW4) connected to the second primary terminal (TL2) and the second source terminal (TS2).

3. The electronic circuit (101) according to claim 2, wherein the electronic circuit (101) comprises a fifth switch (SW5) connected to the first capacitor terminal (TC1) and the first source terminal (TS1).

4. The electronic circuit (101) according claim 2, wherein the electronic circuit (101) comprises a storage capacitor (C2) connected to the first source terminal (TS1) and the second switch (SW2), and a sixth switch (SW6) connected to the second source terminal (TS2) and the storage capacitor (C2), wherein the second switch (SW2) is connected to the second source terminal (TS2) by being indirectly connected to the second source terminal (TS2) via the sixth switch (SW6), which is connected to the second switch (SW2).

5. The electronic circuit (101) according to claim 2, wherein the electronic circuit (101) further comprises a control unit (120).

6. The electronic circuit (101) according to claim 1, wherein the electronic circuit (101) comprises a fifth switch (SW5) connected to the first capacitor terminal (TC1) and the first source terminal (TS1).

7. The electronic circuit (101) according to claim 6, wherein the electronic circuit (101) comprises a fourth switch (SW4) connected to the second primary terminal (TL2) and the second source terminal (TS2).

8. The electronic circuit (101) according claim 6, wherein the electronic circuit (101) comprises a storage capacitor (C2) connected to the first source terminal (TS1) and the second switch (SW2), and a sixth switch (SW6) connected to the second source terminal (TS2) and the storage capacitor (C2), wherein the second switch (SW2) is connected to the second source terminal (TS2) by being indirectly connected to the second source terminal (TS2) via the sixth switch (SW6), which is connected to the second switch (SW2).

9. The electronic circuit (101) according to claim 6, wherein the electronic circuit (101) further comprises a control unit (120).

10. The electronic circuit (101) according claim 1, wherein the electronic circuit (101) comprises a storage capacitor (C2) connected to the first source terminal (TS1) and the second switch (SW2), and a sixth switch (SW6) connected to the second source terminal (TS2) and the storage capacitor (C2), wherein the second switch (SW2) is connected to the second source terminal (TS2) by being indirectly connected to the second source terminal (TS2) via the sixth switch (SW6), which is connected to the second switch (SW2).

11. The electronic circuit (101) according to claim 10, wherein the electronic circuit (101) comprises a fourth switch (SW4) connected to the second primary terminal (TL2) and the second source terminal (TS2).

12. The electronic circuit (101) according to claim 10, wherein the electronic circuit (101) comprises a fifth switch (SW5) connected to the first capacitor terminal (TC1) and the first source terminal (TS1).

13. The electronic circuit (101) according to claim 10, wherein the electronic circuit (101) further comprises a control unit (120).

14. The electronic circuit (101) according to claim 1, wherein the electronic circuit (101) further comprises a control unit (120).

15. The electronic circuit (101) according to claim 14, wherein the electronic circuit (101) comprises a fourth switch (SW4) connected to the second primary terminal (TL2) and the second source terminal (TS2).

16. The electronic circuit (101) according to claim 14, wherein the electronic circuit (101) comprises a fifth switch (SW5) connected to the first capacitor terminal (TC1) and the first source terminal (TS1).

17. The electronic circuit (101) according to claim 14, wherein the electronic circuit (101) comprises a storage capacitor (C2) connected to the first source terminal (TS1) and the second switch (SW2), and a sixth switch (SW6) connected to the second source terminal (TS2) and the storage capacitor (C2), wherein the second switch (SW2) is connected to the second source terminal (TS2) by being indirectly connected to the second source terminal (TS2) via the sixth switch (SW6), which is connected to the second switch (SW2).

18. A capacitor discharge ignition system (100) comprising the electronic circuit (101) according to claim 1.

19. A combustion engine comprising a capacitor discharge ignition system (100) according to claim 18.

* * * * *